US005491602A

United States Patent [19]

Horn et al.

[11] Patent Number: 5,491,602

[45] Date of Patent: Feb. 13, 1996

[54] AIR DISTRIBUTING AND IONIZING SYSTEMS

[75] Inventors: Paul E. Horn, Waterford, Mich.; Mark N. Horenstein, Newton, Mass.; Donald G. Parent, Windham, Me.

[73] Assignee: Paul Horn Enterprises, Inc., Waterford, Mich.

[21] Appl. No.: 440,518

[22] Filed: May 12, 1995

[51] Int. Cl.$^6$ ..... H05F 3/00

[52] U.S. Cl. ..... 361/228; 361/225; 239/690

[58] Field of Search ..... 361/222, 226, 361/227, 228, 235; 239/690, 690.1, 691, 706, 707, 708

[56] References Cited

U.S. PATENT DOCUMENTS

| | | | |
|---|---|---|---|
| 4,077,354 | 3/1978 | Walberg | 118/12 |
| 4,219,865 | 8/1980 | Malcolm | 361/228 |
| 4,290,091 | 9/1981 | Malcolm | 361/228 |
| 4,377,838 | 3/1983 | Levey et al. | 361/228 |
| 4,660,774 | 4/1987 | Kwok et al. . | |
| 5,080,289 | 1/1992 | Lunzer . | |
| 5,196,067 | 3/1993 | Lacchia | 118/694 |
| 5,388,769 | 2/1995 | Rodrigo et al. | 239/690 |

OTHER PUBLICATIONS

Exair Catalog No. 93; Problem Solving Products for Industry; Exair Corporation, 1250 Century Circle N, Cinc. OH 45246.

Typhoon Pamphlet; Air Blow–Off and Ionizing Air Blow–Off Systems; Paul Horn & Associates, 313/682–8490, Pontiac MI 48054.

*Primary Examiner*—Jeffrey A. Gaffin

*Attorney, Agent, or Firm*—Howard & Howard

[57] ABSTRACT

An air amplifying blow-off system incorporating an ionizing apparatus includes a converter driven by the compressed air being directed to an air distributor. The converter provides the power source for the ionizing apparatus. In this way, the air distributor and ionizing apparatus can be an easily contained unit. The system may comprise a turbine which is electrically connected to an ionizing apparatus, such as an ionizing bar. Another system may comprise an oscillatory device connected to a pair of opposing electrodes through a piezoelectric device. The compressed air drives the oscillatory device. The piezoelectric device provides a pulsating supply of voltage to the ionizing device. This invention allows the blow-off/ionizer system to be utilized in potentially explosive environments. Further, the efficiency of the systems is increased since power losses across the relatively long cables incorporated in the prior art systems is eliminated.

20 Claims, 4 Drawing Sheets

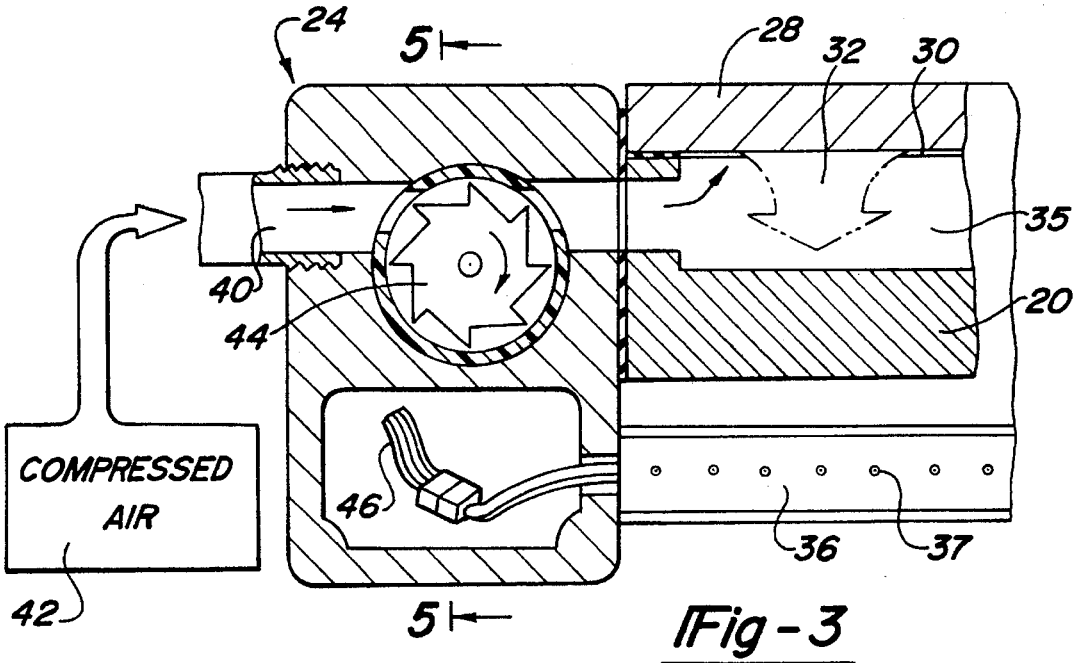
Fig-3
Fig-4
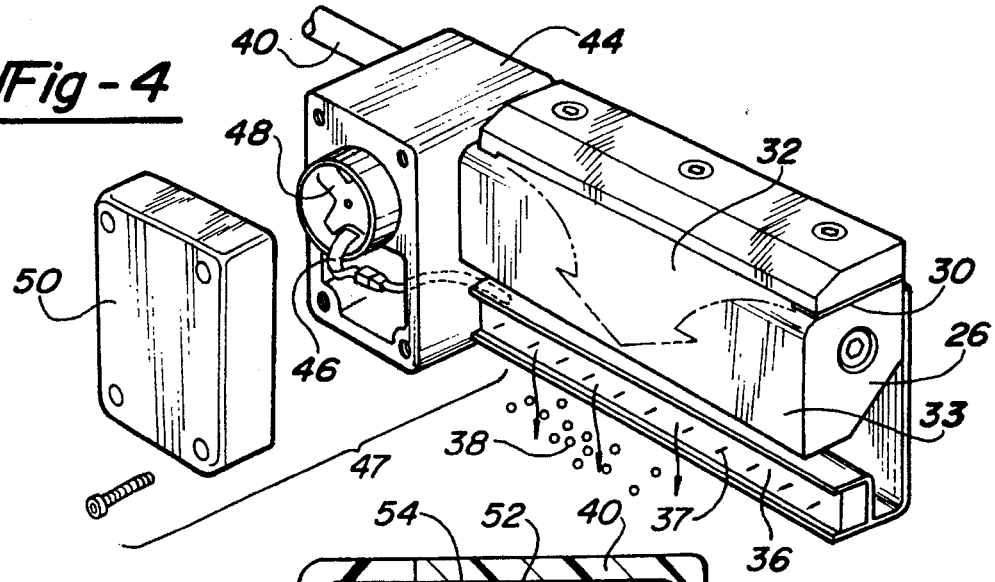
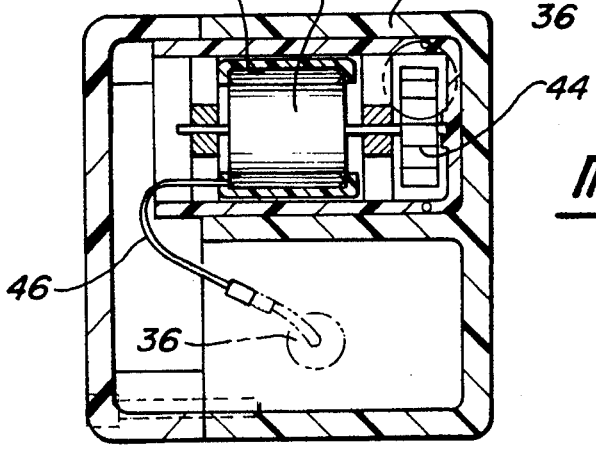
Fig-5

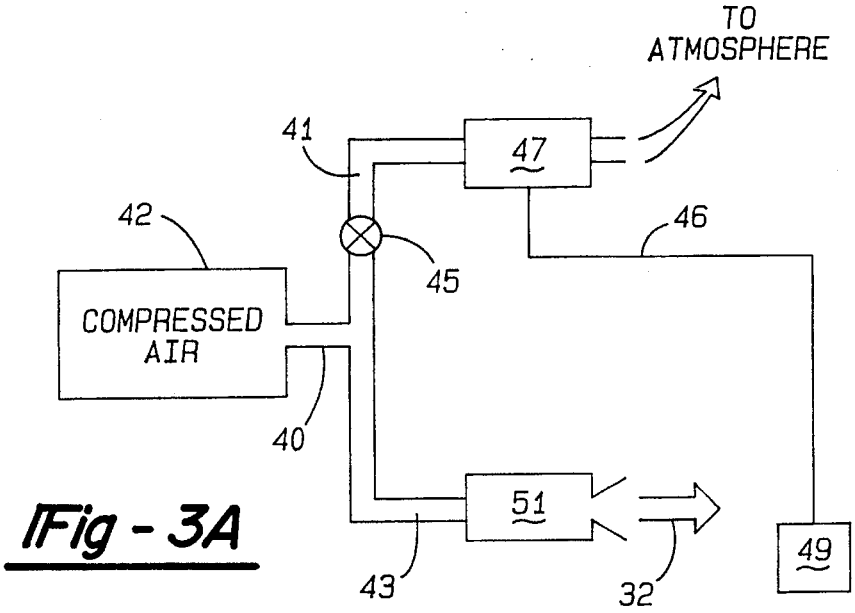
Fig - 3A
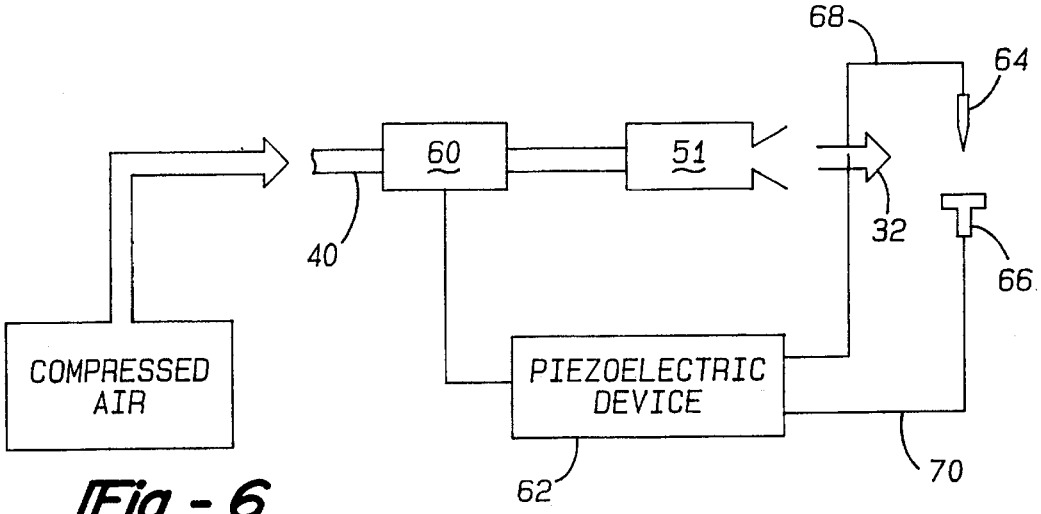
Fig - 6
Fig - 7
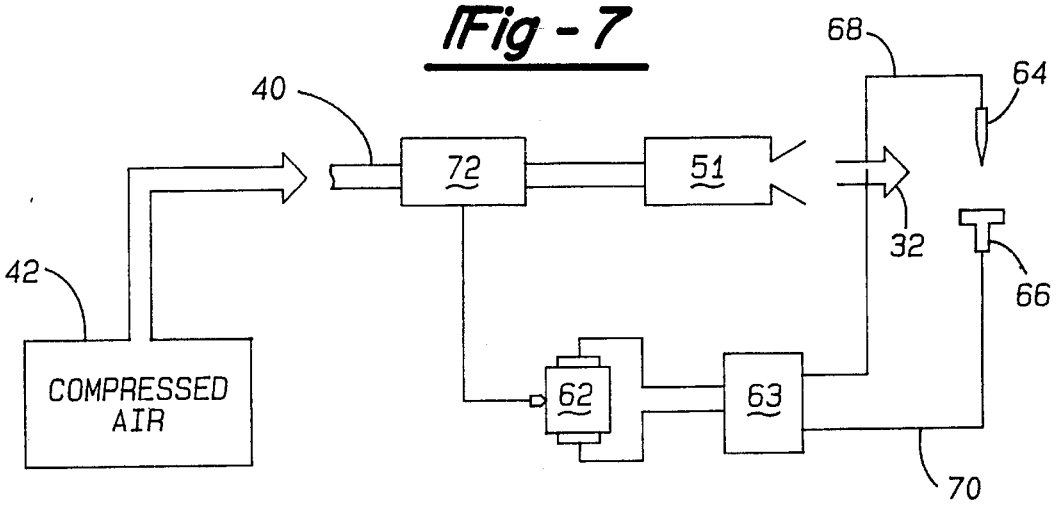

AIR DISTRIBUTING AND IONIZING SYSTEMS

BACKGROUND OF THE INVENTION

This application relates to a converter which utilizes compressed air to provide power to an ionizer associated with an air distributor in an air blow-off assembly.

It is known in the prior art to utilize air nozzles or air amplifiers which direct a large volume of air flow at a part to be cleaned for removing dust or other impurities on the part. Many handling operations for parts generate static. As an example, parts moving on conveyor belts, sliding down chutes, or simply rubbing against one another, generate static. Manual cleaning with tack rags or using a compressed air blow-off to remove dirt may also impart an invisible static charge which attracts or holds more dirt as the part travels along a production line.

In order to address this static problem, the prior art has developed air nozzles and air amplifiers which incorporate an ionizing device that direct charged particles into an air flow in a blow-off system. The charged particles neutralize static charges on the part. In particular, the prior art has developed a system which utilizes an air amplifier consuming a relatively small quantity of compressed air along a wall creating what is known as a "coanda" effect to draw additional air along with the compressed air. The system will often include an ionizing device positioned downstream of the air flow such that the air flow carries the ionized particles towards the surface to be cleaned.

In one common use of such systems, a plurality of such systems are arranged around the body of a vehicle which is to be painted. The several amplifiers and associated ionizing devices neutralize static and, at the same time, remove dirt and dust particles from the vehicle body.

The ionizing device has typically been powered by electric cables connected to a separate power supply generating voltage from five kilovolts to ten kilovolts. These power supplies are normally powered by 110 AC voltage. The large voltage requirements needed by the ionizing device present some challenges.

The prior art systems have been limited in some applications, and have been less efficient than desirable. In particular, the fact that the ionizing devices require relatively high AC voltages to provide the power to operate such ionizers has led to some restriction in the use of such systems in explosive environments. Such explosive environments are often found adjacent vehicle painting locations. The use of high voltage cables and power supplies creates the possibility of electric sparks in the explosive environment. While enclosed power supplies have been proposed, they have not proven practical. Further, the relatively long distances between the several ionizing devices and a power supply has required relatively long lengths of cable to bring power to the ionizing devices. As is known, power loss occurs in any length of electric cable. As such, the efficiency of such systems is reduced.

SUMMARY OF THE INVENTION

The instant invention addresses the above discussed limitations in air distribution and ionizing systems by utilizing the compressed air flow going to the air blow-off device as a power source for a converter. The converter has an output connected to power an ionizing apparatus such as an ionizing bar. In this way, the system does not require any long lengths of cable. Further, the only electrical connection necessary is the input to the ionizing apparatus, which is easily enclosed.

In one disclosed application of this system, compressed air flow is directed outwardly through a small slot on an amplifier body and onto a curved wall surface. The small slot and the air flow parameters are selected, along with the wall surface, to create a "coanda" effect. This results in an amplification of the air drawn along by this relatively small amount of compressed air. Such an air amplifier is known, and its construction forms no part of this invention. Preferred air amplifiers are available under the trade name "Exair-Knife" from Exair Corporation of Cincinnati, Ohio. A worker of ordinary skill in the art would recognize that a particular slot thickness must be maintained, and that a particular wall profile is typically required. Air amplification ratios on the order of 30 to 1 are often achieved with such known air amplification systems.

In one embodiment of this invention, the compressed air leading to the air distribution body (e.g., air amplifier) is directed over a turbine, driving the turbine blades. A rotor and stator assembly are associated with the turbine, and create a source of alternating voltage for an ionizing apparatus. The ionizing apparatus, such as an ionizing bar, is positioned downstream of the air amplifier output. The air flow is thus directed through an ion cloud created by the ionizing bar, and towards the surface to be cleaned.

In a most preferred embodiment of this invention, the compressed air directed to the turbine is the entire flow of compressed air leading to the air distribution body. Thus, in designing the operating parameters of this system, any potential pressure drop across the turbine must be incorporated into the input requirements for compressed air leading to the turbine. The air leaving the turbine must still have sufficient pressure to create the proper air flow at the air distribution body.

In another embodiment of this invention, a portion of the compressed air flow is directed to the turbine, while the remainder of the compressed air flow is directed to an air distribution body. The portion of compressed air flow directed to the turbine creates the power supply to an ionizing apparatus. The air leaving the turbine is vented to atmosphere. This eliminates the concern of pressure-drop across the turbine so that maximum pressure is available at the air distribution body. The total amount of compressed air available must be sufficient to supply both the turbine and the air distribution body.

In another embodiment of this invention, the compressed air leading to the air amplifier is directed over some device that repeatedly contacts a piezoelectric device to create a pulsating voltage. The piezoelectric device is connected to an ionizing apparatus such as an ionizing bar or opposed electrodes. The voltage is applied to the ionizing apparatus which produces an ion cloud. The amplified air is directed over the ionizer through the ion cloud which is positioned downstream of the air amplifier output.

The frequency of the alternating voltage applied to the ionizing apparatus may be choppy or erratic. Thus, the systems of the present invention may include electronic components to provide uniform voltage and frequency to the ionizing apparatus.

In one preferred application of this invention, an arch extends over the body of a vehicle traveling towards a paint line in an automobile assembly facility. A number of air distribution bodies and associated ionizing apparatuses are positioned on the arch such that they will be positioned to clean corresponding portions of the vehicle body. The easily enclosed turbine drive for the ionizing apparatus allows the system to be utilized in an explosive environment, and further reduces energy consumption. No separate electrical power need be supplied to the arch.

In a method of the present invention, compressed air is directed to an air distributor. The air distributor is preferably of the type having a small nozzle or controlled slot such that compressed air leaving the small slot moves along a wall surface, creating an air amplification effect. An ionizing apparatus is positioned downstream of the slot and creates a cloud of alternatively charged ions. The ionizing apparatus is supplied with power from a converter driven by compressed air. The air directs that ion cloud to the surface to be cleaned. The relatively large volume air flow in combination with the alternatively charged ions remove both dust and static charge from the body to be cleaned.

In a preferred method of this invention, the converter and air distribution body are driven by the compressed air flow in a series. Thus, the air being directed to the air distributor is the same air directed to the converter, and the converter is positioned in line in the compressor air flow leading to the air distributor.

In a most preferred method of this invention, the converter and air distribution body are driven by the compressed air in parallel. Thus, the air being directed to the air distribution and ionizing system is split into separate portions, wherein one air flow portion drives the converter and the remainder portion drives the air distribution body. The converter supplies power to an ionizing apparatus, which is downstream of an air flow output created by the air distribution body. Any concern of pressure-drop is thereby eliminated.

These and other features of the present invention can be best understood from the following specification and drawings, of which the following is a brief description.

BRIEF DESCRIPTION OF THE DRAWINGS

FIG. 3 is a cross-sectional view, partially schematically shown, of an inventive system, designed in a full "series" circuit.

FIG. 3A is a schematic drawing of an alternative embodiment of an inventive air distribution and ionizing system, designed in a "parallel" circuit.

FIG. 4 is an assembly view of an inventive system.

FIG. 5 is a cross-sectional view through one portion of the invention shown in FIG. 4 in the direction of view across 5—5.

FIG. 6 is a schematic drawing of an alternative embodiment of an inventive air distribution and ionizing system.

FIG. 7 is a schematic drawing of another alternative embodiment of an inventive air distribution and ionizing system.

DETAILED DESCRIPTION OF THE PREFERRED EMBODIMENT

Figure 1:
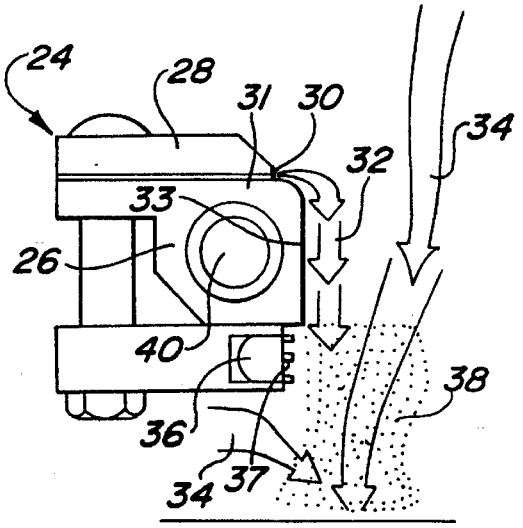
Fig - 1 PRIOR ART
FIG. 1 shows one application of an air amplification and ionizing system for cleaning vehicle bodies.

FIG. 1 shows an air amplification system 20 built into an arch 22 having a number of air amplifier/ionizing bar combinations 24. The combinations 24 are positioned about the surface of a vehicle 26, and provide air and charged particles to remove dust and static charge from the vehicle as the vehicle moves through arch 22 on the way to a vehicle painting station. The operation of the combinations 24 is known, as is the arch application.

The arch has not been capable of being as close as desired to the potentially explosive area adjacent the painting station for the reasons discussed above. This invention is directed to addressing this goal.

Figure 2:
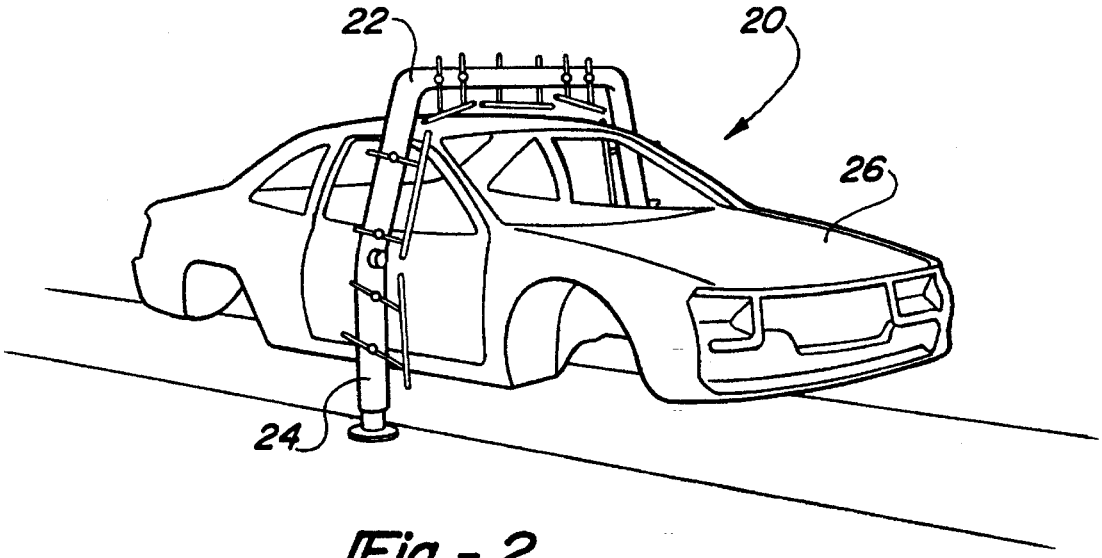
Fig - 2 PRIOR ART
FIG. 2 shows a side view of a typical air amplifier and ionizing system.

The combinations 24 are shown more clearly in FIG. 2. As is known, a first housing body 28 forms an elongated slot or nozzle 30 with a second housing body 31. A relatively small volume, high velocity air flow 32 leaves slot 30 and moves along the curved surface of a wall 33, adhering to the wall. That air flow 32 creates a relatively high volume ambient air flow 34. Amplification rates on the order of 30 to 1 may be achieved with such systems. The air flow and resulting amplification of the air is achieved by a physical phenomenon known as the "coanda" effect. The prior art is aware of how to control the size of slot 30, the structure of the wall 33, along with the parameters of the air flow 32 to create the coanda effect.

An ionizing bar 36 is positioned downstream of the combined air flow 32 and 34. An ion cloud 38 is created by charged pins 37 associated with ionizing bar 36. The combined air flow entrains ion cloud 38 and directs it towards a surface to be cleaned. Ionizing bar 36 is supplied with AC voltage, and creates both positively and negatively charged ions. A compressed air line 40 leads to the slot 30. The structure of the invention to this point is as known in the art. The instant invention relates to the method of supplying electrical power to ionizing bar 36.

As shown in FIG. 3 in a first embodiment, a compressed air source 42 is connected to compressed air line 40. Turbine blade 44 is positioned in compressed air line 40. The air drives turbine blade 44, then moves into a plenum 35 before exiting slot 30. The air driving the turbine 44 creates an electrical voltage that is connected to ionizing bar 36 through a connection 46. Ionizing bar 36 has a number of conductive pins 37, which create negatively and positively charged ions. The air flow 32 leaving slot 30 creates an air amplification which moves with the ion cloud towards the surface to be cleaned, as can be understood with reference to FIG. 2.

The incorporation of turbine 44 into compressed air line 40, achieves a combination wherein no outside electrical power source is required. This provides the unexpected benefit of allowing the use of this air ionizing type system in explosive environments. Further, the inevitable power losses along the relatively long cables that were required in the prior art are also eliminated.

Moreover, in the prior art, the cables leading from the combinations 24 had to extend to electric power sources. The elimination of such lines in an industrial environment is an important benefit reducing the complexity of the industrial assembly line and reducing the risk of electrocution or explosion.

Thus, the combination of these elements into an enclosed air distributing and ionizing system provides valuable benefits.

As shown in FIG. 4, turbine 44 incorporates a housing 47 enclosing a pair of spacers 48, one of which is shown, and an outer cover 50.

As shown in FIG. 5, turbine blade 44 is connected to a rotor 52 received within a stator 54. As is known in the art, upon rotation of rotor 52, an electric charge is created in the stator 54 which is then passed through connection 46 to the ionizing bar 36. As also shown, connection 46 is sealed from the outside environment. The electric details required for achieving this embodiment of the invention form no part of this invention, and a worker of ordinary skill would be able to develop the required circuitry.

Turbine 44 may cause some pressure drop on the compressed air in line 40. This pressure drop must be taken into account when determining the desired input parameters for the compressed air source 42 directed into line 40 such that the compressed air reaching slot 30 is of the desired velocity and pressure. Again, a worker of ordinary skill in the art would recognize that such calculations can be easily made once the pressure drop is known.

As shown in FIG. 3A, one method of eliminating problems associated with the pressure drop in the compressed air flow includes running the converter and air distribution body in parallel. Compressed air source 42 is connected to air line 40 which splits into air lines 41 and 43. A valve 45 is disposed in line 41 to regulate the air flow from line 40 to lines 41 and 43. The portion of compressed air passing through line 41 is directed to converter 47, such as a turbine, which drives the converter. The portion of air driving the converter 47 creates an electrical voltage that is connected to an ionizing device 49 through connection 46. The air flow driving,converter 47 is then vented to atmosphere. The remainder portion of compressed air flow passes through line 43 toward an air distribution body 51 which produces an air flow 32. The voltage supplied to ionizer 49 from converter 47 produces an ion cloud, as described above. Air flow 32 entrains the ion cloud and directs it toward a surface to be cleaned.

An alternative air distributor/ionizer system is shown in FIG. 6. An apparatus 60 is positioned in compressed air line 40 such that at least a portion of the compressed air supplied to compressed air line 40 from compressed air source 42 drives apparatus 60. In one alternative embodiment, apparatus 60 comprises a conventional air motor which extracts rotational mechanical energy from the compressed air stream in line 40. For example, apparatus 60 could be a turbine as described above. The rotational energy is converted to oscillating mechanical stress on a piezoelectric device 62 through a crank, cam or other known method. As is known when a piezoelectric device 62 is oscillated it produces a pulsating high voltage output. The voltage is applied across electrodes 64 and 66 through lines 68 and 70, respectively, from piezoelectric device 62. Electrode 66 is a conventional electrode, while electrode 64 has a salient feature, such as a sharp point. The electric field supplied by piezoelectric device 62 concentrates on the sharp point of electrode 64, thereby producing very high values of electric field in the region surrounding the point of electrode 64. Air molecules are ionized due to the high intensity electric field near the point of electrode 64, but no arc should be produced across the electrodes. Since an AC voltage is applied between the electrodes 64 and 66, a relatively homogeneous ion cloud between and adjacent electrodes 64 and 66 is produced. The compressed air flow traveling through apparatus 60 then passes through to air distribution body 51 which produces air flow 32. Air flow 32 passes through the ion cloud, as described above, to provide an air flow having charged particles to remove dust and static charge.

In another alternative embodiment shown in FIG. 7, an oscillatory device 72 extracts mechanical energy from the air stream in line 40. The other features of this embodiment are as shown in FIG. 6. The apparatus 72 is excited by the moving air stream such that it vibrates. This oscillatory energy is then converted to oscillating mechanical stress on the piezoelectric device 62 through simple mechanical impact. In one example, device 72 may be a mechanical multi-vibrator device driven by the moving air stream in line 40. The multi-vibrator converts the mechanical energy applied by the air stream on the multi-vibrator device into oscillatory mechanical stress which is supplied to piezoelectric device 62. The piezoelectric device 62 produces an AC high voltage output, as described above.

In a preferred embodiment, an electrical or electronic circuit 63 is supplied between the piezoelectric device 62 and electrodes 64 and 66. The circuit 63 shapes the AC characteristics of the high voltage output from the piezoelectric device by removing unwanted frequency components from the output voltage or by changing the output frequency to a more desirable value. The circuit may also perform both functions. The circuit may include a high voltage transformer, inductor, capacitor or any combination thereof. Additionally, an air cooled chopping circuit may be included to provide a more uniform, homogeneous current to the ionizing apparatus 82.

In a further alternative embodiment, the AC voltage from the piezoelectric device drives a standard ionizing bar, as described above.

Figure 8:
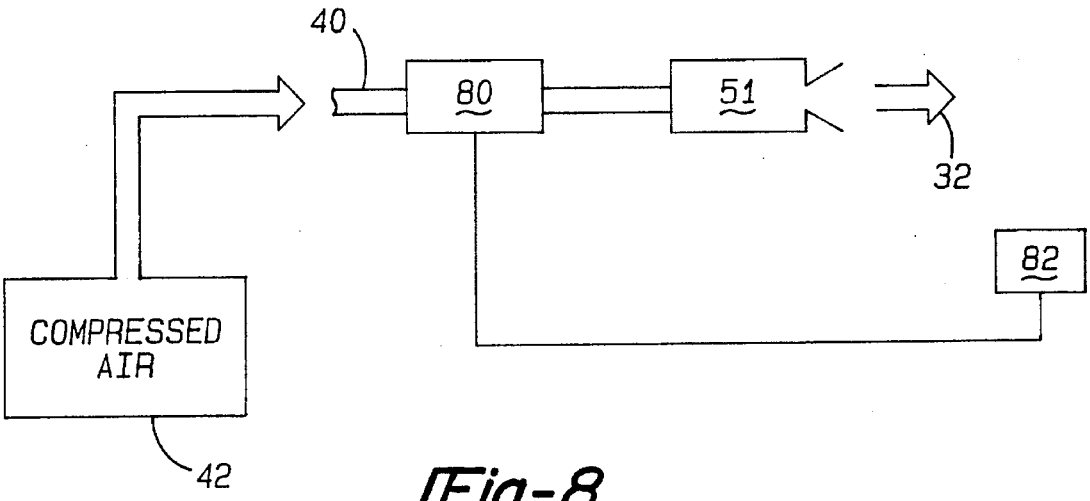
FIG. 8 is a schematic drawing of another embodiment of an inventive air distribution and ionizing system.

As shown in FIG. 8, another alternative embodiment includes an apparatus 80 coupled with compressed air line 40 and electrically connected to an ionizing device 82. In one such embodiment, apparatus 80 comprises a generator designed specifically to produce high voltage AC directly from a rotating direct current (DC) magnet rotor mounted in compressed air line 40. Generator 80 is connected to an ionizing apparatus 82 such as an ionizing bar, as described above. Ionizing apparatus 82 ionizes air molecules with the high intensity electric field supplied from apparatus 80. Preferably, a structure is provided which maintains a substantially constant rotational velocity of the rotor in generator 80. The structure eliminates erratic ionization at the ionizing apparatus 82.

In a second such embodiment, apparatus 80 comprises a high voltage oscillating secondary transformer which produces a high frequency voltage output (e.g., 20kHz). The high frequency voltage output is supplied to the ionizing apparatus 82 to produce an ion cloud, as described above.

In a third embodiment, apparatus 80 comprises a generator which produces high voltage AC from a rotating DC magnet rotor, as in the first embodiment described above, but the high voltage AC is segregated or rectified to positive and negative DC. Separate positive and negative high voltage DC would be produced and supplied to separate ionizing apparatuses 82 having separate emitter points. Separate ion clouds of different polarity would be produced. The compressed air flow passing through apparatus 80 then passes through to air distribution body 51 which produced air flow 32, as described above. Air flow 32 is then directed over the segregated ion clouds. Preferably, there is sufficient turbulence in the air flow passing over ionizing device 82 to produce a homogeneous flow of air and ions.

Moreover, the same treatment aspects described with regard to FIG. 8 may have applications in the other types of systems described in FIGS. 3–7. The electronic circuit described above may also be incorporated into the system of FIG. 8 between generator 80 and ionizing apparatus 82 to improve the AC characteristics of the high voltage output.

Figure 8A:
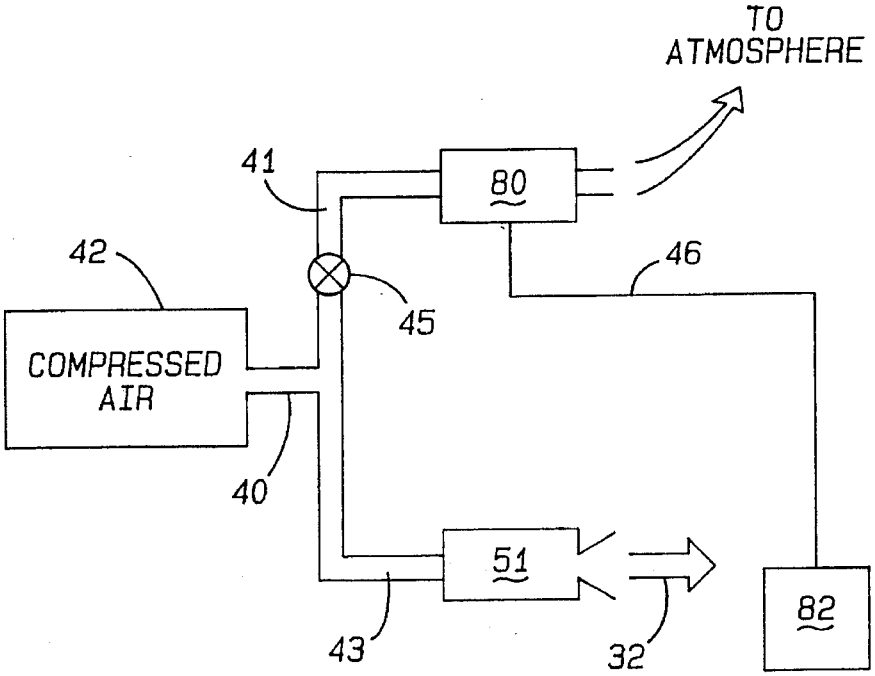
FIG. 8A is a schematic drawing of another embodiment of an inventive air distribution and ionizing system.

As shown in FIG. 8A, apparatus 80 and air distribution body 51 may operate in parallel. Compressed air from source 42 is split into parallel flows in lines 41 and 43, with valve 45 regulating the flow between lines 41 and 43. The portion of compressed air flow through line 41 drives apparatus 80 and then is vented to atmosphere. Apparatus 80, such as a generator, produces high voltage AC which is supplied to ionizing apparatus 82 through line 46 to produce an ion cloud, as described above. The remainder portion of compressed air flow travels through line 43 to air distribution body 51 to produce air flow 32.

Finally, although the specifically disclosed embodiments use air amplifiers, it should be understood that the benefits of this invention extend to non-amplifying air distribution systems, such as standard blow-off.

A preferred embodiment of the present invention has been disclosed; however, a worker of ordinary skill in the art would recognize that certain modifications would come within the scope of this invention. For that reason, the following claims should be studied in order to determine the true scope and content of this invention.

We claim:

1. An air distributing and ionizing system comprising:

an air distribution body receiving a flow of compressed air;

an ionizing apparatus for creating an ion cloud positioned in an air flow created by said air distribution body;

a source of compressed air in fluid communication with said air distribution body;

a converter in fluid communication with said source of compressed air;

at least a portion of the air from said source of compressed air passing over said converter, said converter being driven by the air flow portion; and said converter being operably connected to provide an electric power source to said ionizing apparatus upon being driven by the air flow portion.

2. The system as recited in claim 1, wherein said converter comprises a turbine, said converter disposed between said distribution body and said source of compressed air, and the entirety of said air flow leading to said air distribution body passes over said turbine on the way to said air distribution body.

3. The system as recited in claim 1, wherein said ionizing apparatus utilizes alternating voltage, and creates an alternating supply of positively and negatively charged ions.

4. The system as recited in claim 1, wherein said air distribution body is an air amplifier having an amplifying body including a relatively small slot positioned adjacent to a curved wall selected to create a "coanda" effect air amplification system.

5. The system as recited in claim 4, wherein there is a plurality of said amplifying bodies and associated one of said ionizing bars mounted on an arch positioned on a vehicle assembly line.

6. The system as recited in claim 1, wherein said ionizing apparatus comprises a pair of opposed electrodes, and said converter comprises an air motor and crank, which actuate a piezoelectric device to create an alternating supply of positively and negatively charged ions to said electrodes.

7. The system as recited in claim 1, wherein said ionizing apparatus comprises a pair of opposing electrodes, and said converter comprises an oscillatory device connected to said electrodes through a piezoelectric device, and said piezoelectric device providing a voltage source to said electrodes.

8. The system as recited in claim 1, wherein said converter comprises a generator having a rotating magnet rotor and said generator operably connected to provide high voltage alternating current to said ionizing apparatus upon being driven by said air flow, said current being rectified into positive and negative D.C. components.

9. The system as recited in claim 8, wherein said positive and negative components are sent to said ionizing device, said ionizing device including distinct emitter points for receiving said components.

10. The system as recited in claim 1, wherein said air distribution body is an air amplifier which increases the volume of air flow.

11. A method of directing a flow of air to a surface to be cleaned comprising the steps of:

1) directing at least a portion of a flow of compressed air to a converter;

2) causing said compressed air flow to drive said converter;

3) said converter creating an alternating electric voltage;

4) directing the remainder of said flow of compressed air to an air distributor to create an air flow;

5) connecting said converter to an ionizing apparatus such that said voltage drives said ionizing apparatus creating an ion cloud;

6) positioning said ionizing apparatus such that said ion cloud is within the air flow path created by said air distributor; and 7) directing said air flow and said ion cloud to a surface to be cleaned.

12. The method as recited in claim 11, wherein the air distributor is an air amplifier creating a relatively large volume air flow.

13. The method as recited in claim 12, wherein the entirety of said flow of compressed air passes over said converter as it travels toward said air amplifier.

14. The method as recited in claim 13, wherein said air amplifier is a coanda-effect air amplifier, and further including, the step of determining the pressure of said compressed air in step 1) including accounting for, the pressure drop across said converter to ensure that the air leaving said converter will be of the proper pressure and velocity to create the coanda effect at the air amplifier.

15. The method as recited in claim 11, wherein the current generated in step 3) is alternating current.

16. An air amplifying and ionizing combination comprising:

a plurality of air amplifying bodies, each being adapted to receive a source of relatively low volume compressed air, and create a relatively large volume air flow;

an ionizing apparatus associated with each of said ionizing bodies for creating an ion cloud positioned in the large volume air flow created by said amplifying body;

said compressed air being directed to said amplifying body, at least a portion of the air from said source of air passing through a converter on the way to said amplifying body, said converter being driven by the air flow portion; and said converter being operably connected to provide current to said ionizing apparatus upon being driven by the air flow portion, said ionizing apparatus in turn producing both positive and negatively charged ions.

17. The combination as recited in claim 16, wherein said air amplifying bodies and said ionizing apparatuses are mounted on an arch positioned in a vehicle assembly line, such that a relatively large volume air flow from said air amplifying bodies entrains said ion cloud, and directs said relatively large volume of air flow and said ion cloud to a vehicle moving through said arch.

18. A combination as recited in claim 17, wherein said amplifying bodies include a relatively small slot positioned adjacent to a curved wall selected to create a "coanda" effect air amplification system.

19. A combination as recited in claim 18, wherein the entirety of said air flow passes over said converter on the way to said amplifying bodies.

20. A combination as recited in claim 16, wherein the entirety of said air flow passes over said converter on the way to said amplifying bodies.

* * * * *